US007043780B1

(12) United States Patent
Cheng

(10) Patent No.: US 7,043,780 B1
(45) Date of Patent: May 16, 2006

(54) SUPPORTING FOOT OF A BABY MESH BED

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 11/046,831

(22) Filed: Feb. 1, 2005

(51) Int. Cl.
*A47C 7/00* (2006.01)

(52) U.S. Cl. ..... 5/99.1; 5/98.1; 16/18

(58) Field of Classification Search ..... 16/18; 5/98.1, 99.1
See application file for complete search history.

(56) References Cited

U.S. PATENT DOCUMENTS 2,996,752 A * 8/1961 Pope ..... 16/18 R
3,828,376 A * 8/1974 Miller ..... 5/200.1
5,173,990 A * 12/1992 Owen ..... 16/18 CG
6,079,063 A * 6/2000 Cheng ..... 5/98.1
2003/0006572 A1* 1/2003 Huang ..... 280/79.11
2003/0019705 A1* 1/2003 Lau ..... 190/18 A
2004/0046486 A1* 3/2004 Wicha ..... 312/7.2
2004/0194221 A1* 10/2004 Thompson et al. ..... 5/720
2005/0066472 A1* 3/2005 Graham et al. ..... 16/42 T
2005/0229311 A1* 10/2005 Brooke et al. ..... 5/618

* cited by examiner

*Primary Examiner*—Suzanne Barrett
*Assistant Examiner*—Jonathan Liu
(74) *Attorney, Agent, or Firm*—Rosenberg, Klein & Lee

(57) ABSTRACT

A baby mesh bed includes a supporting foot, which is connected to the frame, and which includes a main body, and an ornamental cover; an upright rod part of the frame is inserted in the main body, and a connecting element is passed through the upright rod part and the main body; a horizontal rod part of the frame is inserted in a holding space of the main body at a flat insertion end portion thereof while a second connecting element is passed through the horizontal rod part and the main body; the flat insertion end portion has a slightly smaller thickness than the holding space therefore there is virtually no space between the flat insertion end portion and the main body; the ornamental cover is positioned on the main body to cover both the connecting elements, thus preventing the connecting elements from being seen.

2 Claims, 5 Drawing Sheets

SUPPORTING FOOT OF A BABY MESH BED

BACKGROUND OF THE INVENTION

1. Field of the Invention

The present invention relates to a supporting foot of a baby mesh bed, more particularly one, which has a main body connected to the frame of a baby mesh bed in such a way as to eliminate the risk of people's fingers being clipped while the frame is being angularly displaced relative to the main body, and which has an ornamental cover matching the main body in color and positioned on the main body so as to cover the connecting elements, which are used to connect the main body to the frame, for preventing the connecting elements from spoiling the look of the mesh bed.

2. Brief Description of the Prior Art

A conventional folding mesh bed for baby includes a frame, and four supporting feet. The frame includes four upright rod parts, and four horizontal rod parts. Each supporting foot has a holding room, and a holding space, and is connected to one of the upright rod parts with a lower end of the upright rod part being inserted in the holding room; a connecting element is passed through both the supporting foot and the upright rod part. The horizontal rod parts are respectively passed into the holding spaces of the supporting feet at outward ends thereof, and they are respectively pivoted to the supporting feet by means of pivotal elements.

The above conventional supporting feet of a mesh baby bed have disadvantages as followings:

1. Children are allowed to loosen the connecting elements and the pivotal elements with a tool because the connecting elements and the pivotal elements aren't covered. Consequently, the mesh bed will be unsafe to use.
2. The connecting elements and the pivotal elements might come loose after the mesh bed is used for a certain length of time, and the users have to check from time to time for the sake of safety. Therefore, the supporting feet aren't convenient to use.
3. There is a relatively large space between the outward ends of the horizontal rod parts and the corresponding supporting feet, and in turn people's fingers are prone to get clipped while the horizontal rod parts are being pivoted on the supporting feet.

SUMMARY OF THE INVENTION

It is a main object of the present invention to provide an improvement on a supporting foot of a mesh bed for baby to overcome the above disadvantages.

The supporting foot is connected to the frame of the mesh bed, and includes a main body, and an ornamental cover. An upright rod part of the frame is inserted in the main body, and a connecting element is passed through the upright rod part and the main body. And, a horizontal rod part of the frame is inserted in a holding space of the main body at a flat insertion end portion thereof, and a second connecting element is passed through the horizontal rod part and the main body; the flat insertion end portion has a slightly smaller thickness than the holding space therefore there is virtually no space between the flat insertion end portion and the main body, and there will be no risk of people's fingers being clipped while the horizontal rod part is being pivoted on the support foot. The ornamental cover is positioned on the main body to cover both the connecting elements, thus preventing the connecting elements from spoiling the look of the supporting foot.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
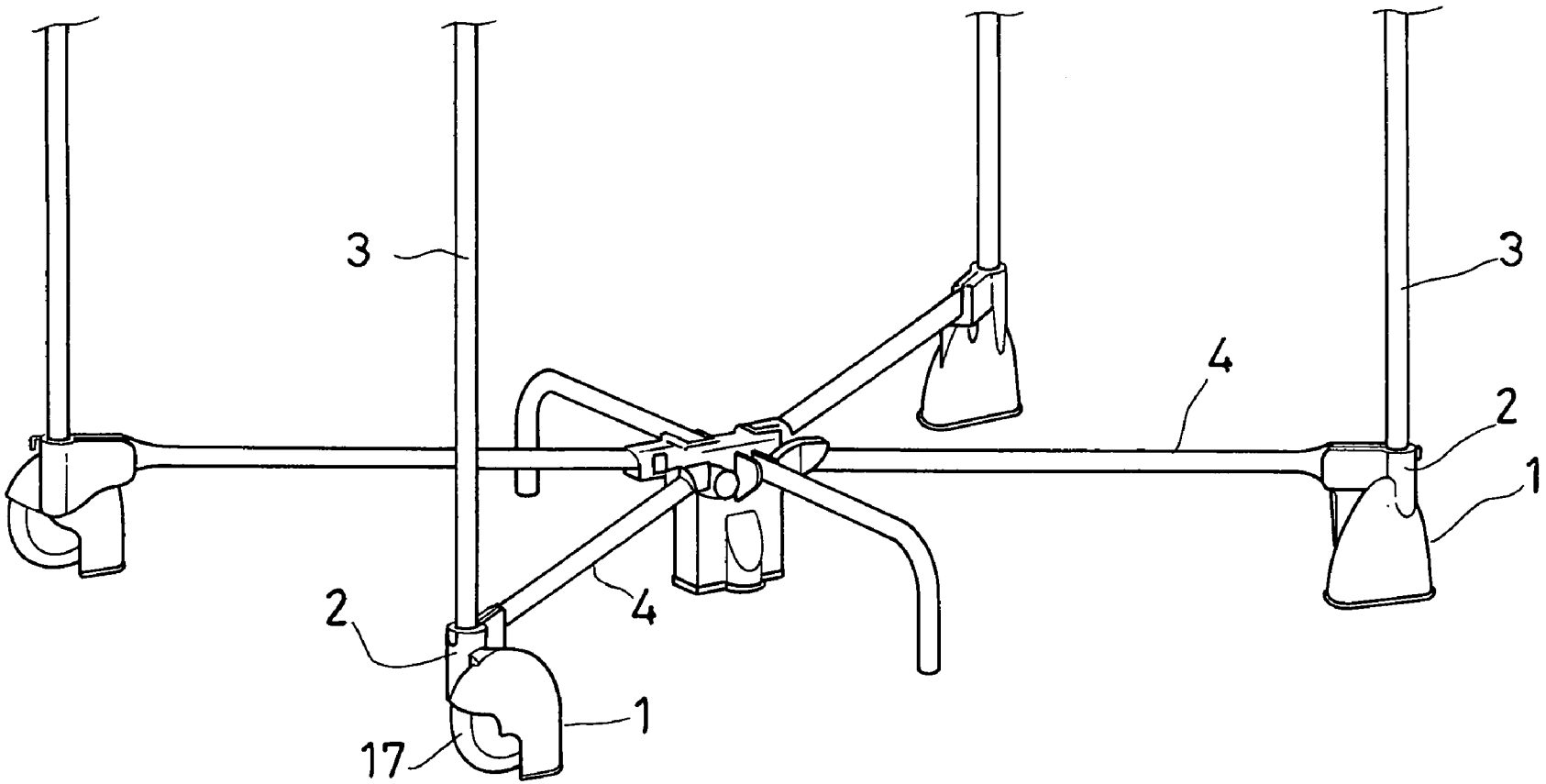
FIG. 1 is a fragmentary perspective view of a lower part of a baby mesh bed according to the invention.
Figure 2:
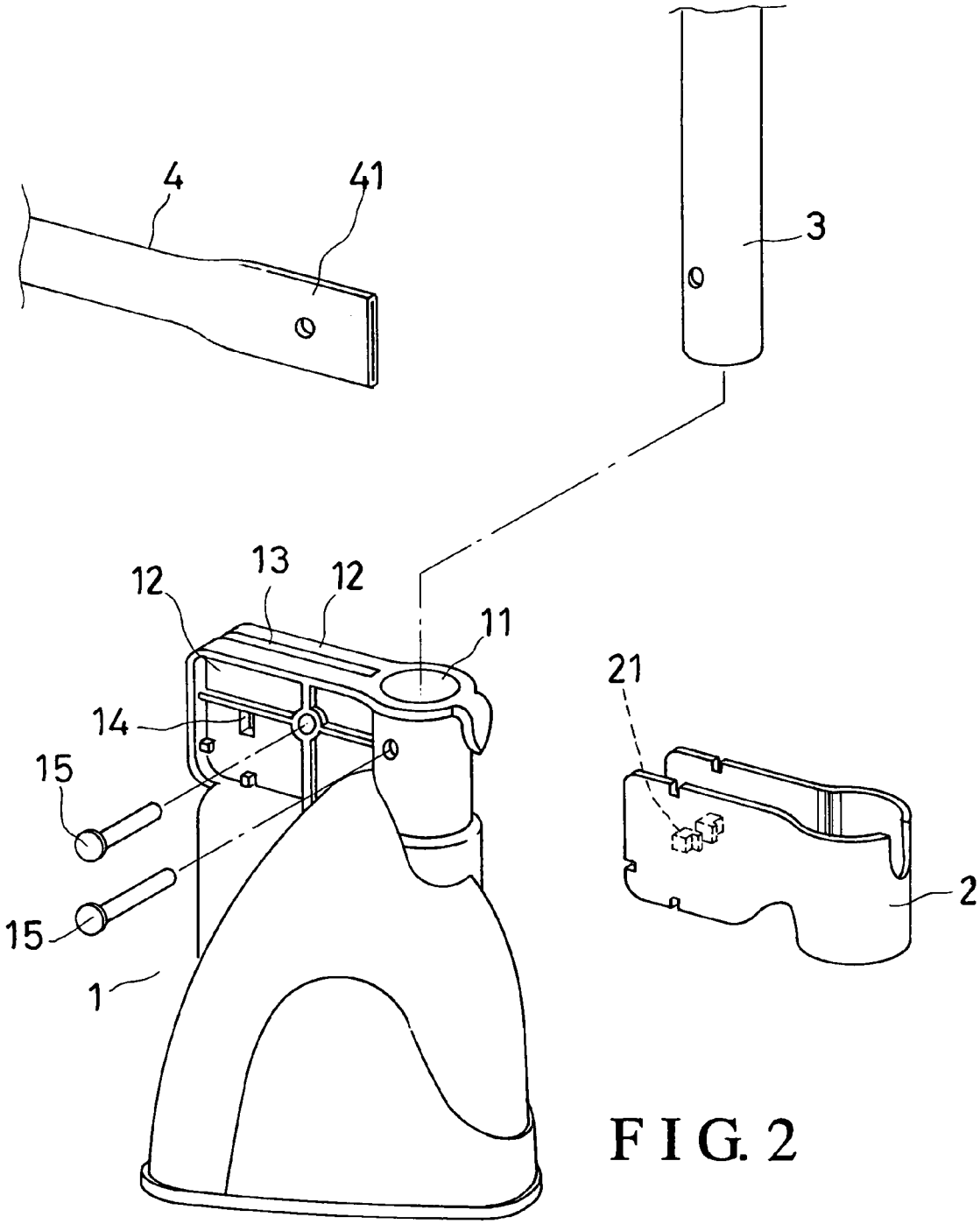
FIG. 2 is an exploded perspective view of the first embodiment of a supporting foot of a baby mesh bed, separated from the bed frame.
Figure 3:
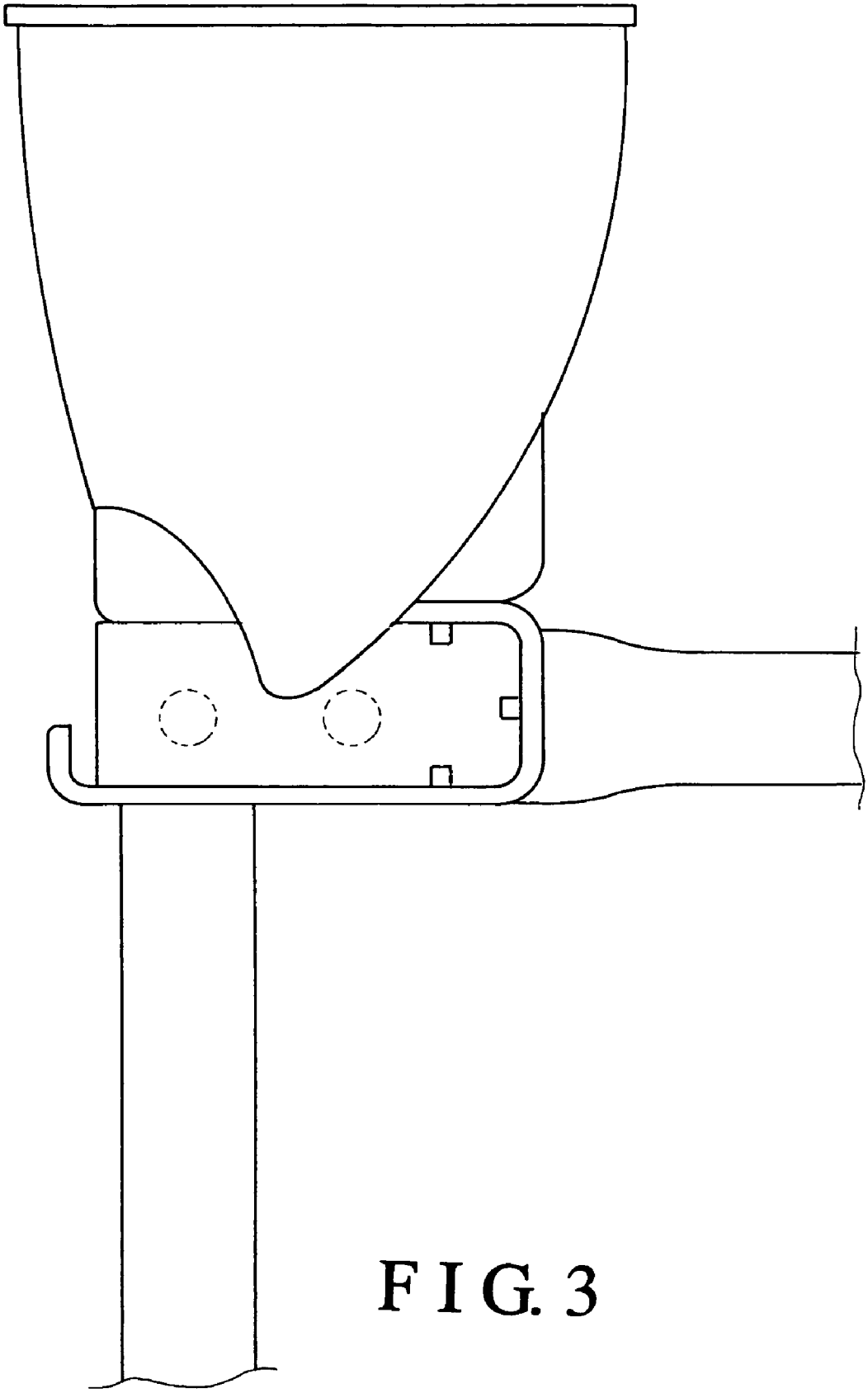
FIG. 3 is a side view of the first embodiment of a supporting foot of a baby mesh bed, connected to the bed frame.

Referring to FIGS. 2 and 3, a preferred embodiment of a supporting foot of a baby mesh bed includes a main body 1, and an ornamental cover 2.

The main body 1 has a holding room 11, two opposing lateral wall portions 12, a holding space 13 between the lateral wall portions 12, and a fitting hole 14 on each of the lateral wall portions 12. The holding room 11 has an opening at an upper end.

The ornamental cover 2 has a substantially U-shaped profile, and has a fitting hook 21 on each of inner sides of two opposing lateral portions thereof. Furthermore, the ornamental cover 2 matches the main body 1 in color and design such that the supporting foot is attractive.

Figure 4:
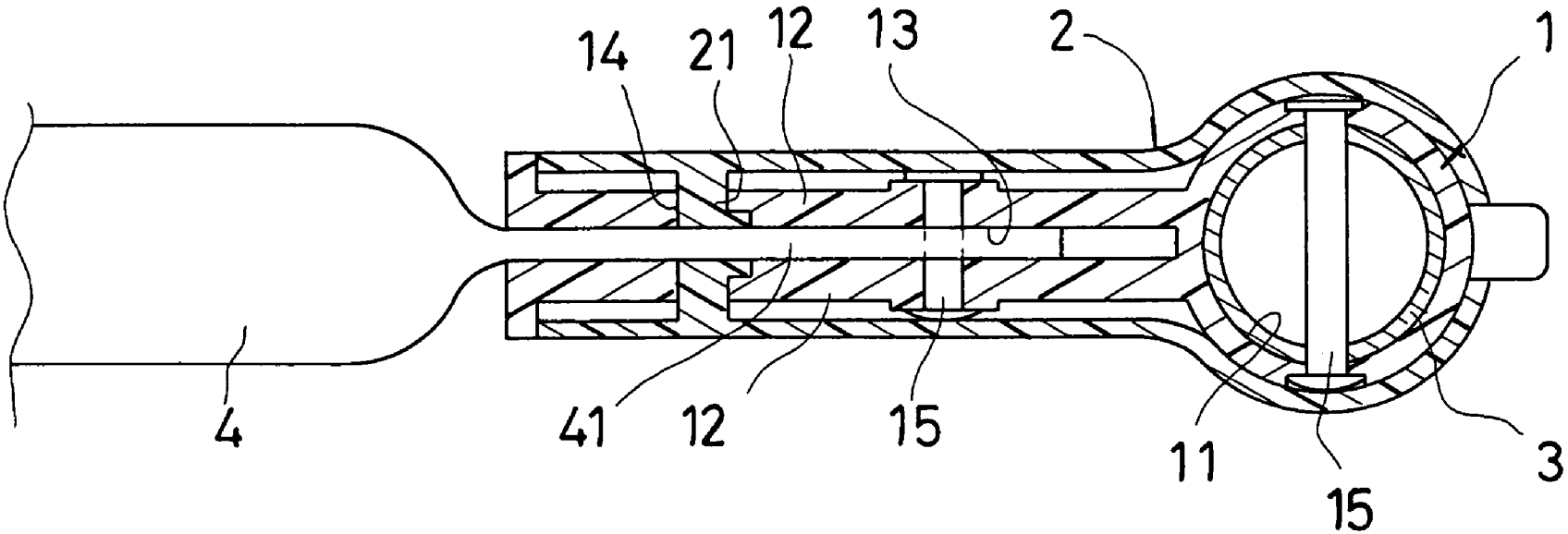
FIG. 4 is a horizontal sectional view of the first embodiment of a supporting foot of a baby mesh bed, connected to the bed frame.

Referring to FIGS. 3 and 4, to join the main body 1 of the supporting foot and a frame of the baby mesh bed, one upright rod part 3 of the frame is inserted in the holding room 11 of the main body 1 at a lower end, and a connecting element 15 is passed through both the main body 1 and the upright rod part 3. And, a horizontal rod part 4 of the frame, which has a flat insertion end portion 41, is passed into the holding space 13 at the flat insertion end portion 41, and a connecting element 15 is passed through the lateral wall portions 12 of the main body 1 as well as the flat insertion end portion 41 of the horizontal rod part 4; the flat insertion end portion 41 of the horizontal rod part 4 has a slightly smaller thickness than the holding space 13 of the main body 1. Thus, the upright rod part 3 is securely connected to the main body 1 while the horizontal rod part 4 is pivoted to the main body 1. Then, the ornamental cover 2 is positioned onto the main body 1 with the fitting hooks 21 thereof being respectively passed through the fitting holes 14 and hooked over the lateral wall portions 12 of the main body 1; thus, the connecting elements 15 are covered with the ornamental cover 2.

Figure 5:
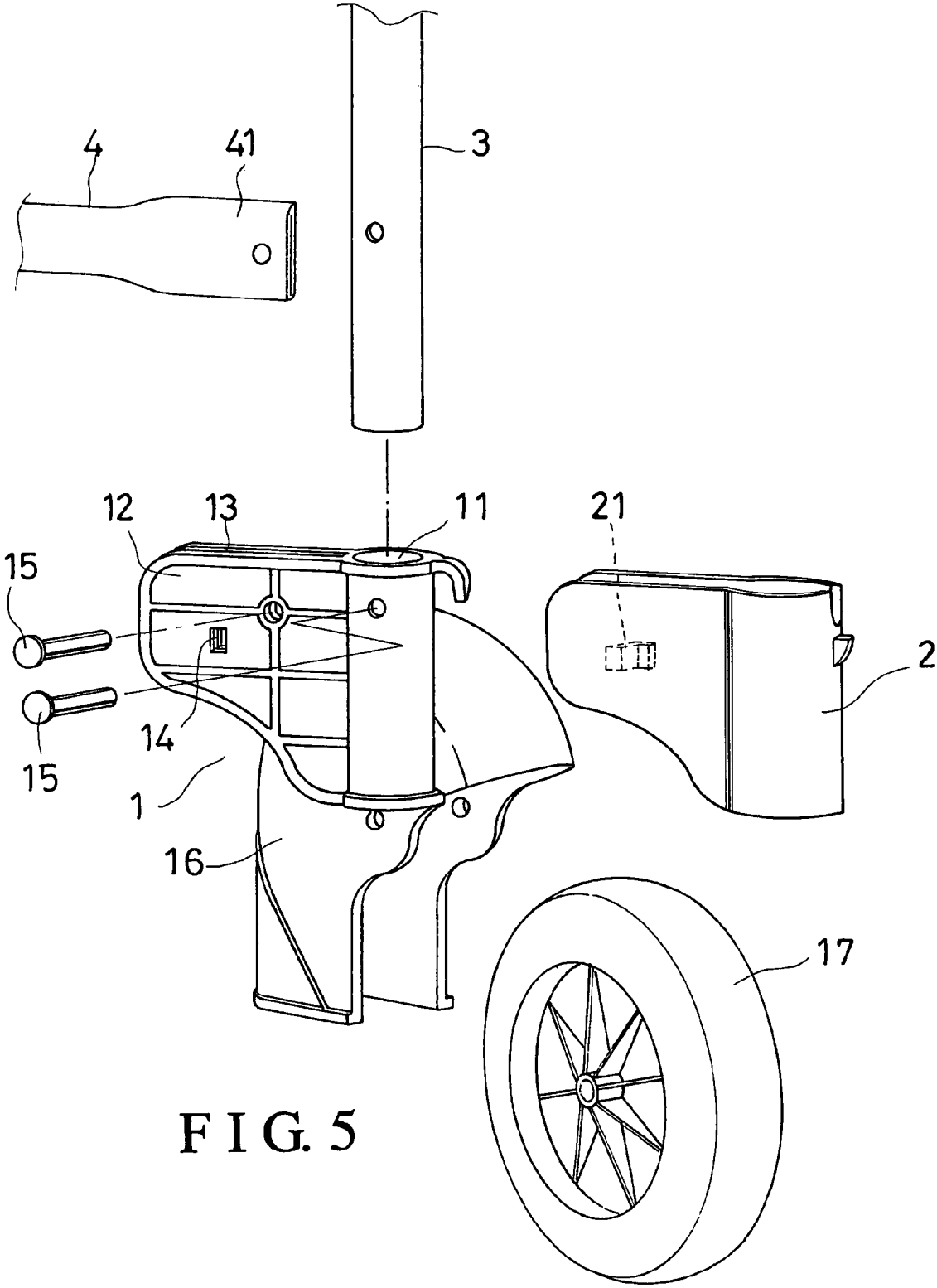
FIG. 5 is an exploded perspective view of the second embodiment.

Referring to FIG. 5, the main body 1 of the supporting foot is further formed a caster supporting portion 16, and a caster 17 is positioned in and connected to the caster supporting portion 16. Thus, the baby mesh bed is easy to move.

From the above description, it can be easily understood that the supporting foot of a baby mesh bed has advantages as followings:

1. The connecting elements of the supporting foot can't be seen because the supporting foot has the ornamental cover, which covers the connecting elements. Consequently, the look of the supporting foot and the mesh bed won't be spoiled by the connecting elements.

2. The main body and the ornamental cover of the supporting foot match, and in turn the mesh bed is more attractive.

3. The ornamental cover can prevent the connecting elements from coming loose, and an accident is prevented that results from coming loose of the connecting elements.

4. There is virtually no space between the flat insertion end portion of the horizontal rod part and the lateral wall portions of the main body therefore there will be no risk of people's fingers being clipped while the horizontal rod part is being pivoted on the support foot.

What is claimed is:

1. A supporting foot of a baby mesh bed, comprising a main body; the main body having a holding room, which has an opening at an upper end; the main body having two opposing lateral wall portions; the main body having a holding space between the lateral wall portions; the main body having a fitting hole on each of the lateral wall portions; the main body being connected to one upright rod part of a frame of a baby mesh bed with the upright rod part being inserted in the holding room; the frame having one horizontal rod part having a flat insertion end portion; the horizontal rod part being pivoted to the main body with the flat insertion end portion being inserted in the holding space of the main body, and with a connecting element being passed through the lateral wall portions of the main body and the flat insertion end portion; the flat insertion end portion of the horizontal rod part having a slightly smaller thickness than the holding space of the main body;

a connecting element passed through both the main body and the upright rod part of the frame for securing the upright rod part to the main body; and an ornamental cover; the ornamental cover having a substantially U-shaped profile; the ornamental cover having a fitting hook on each of inner sides of two opposing lateral portions thereof; the ornamental cover being positioned onto the main body to cover both the connecting elements, thus preventing both the connecting elements from being seen;

the fitting hooks of the ornamental cover being respectively passed through the fitting holes of the main body and hooked over the lateral wall portions of the main body.

2. The supporting foot of a baby mesh bed as claimed in claim 1, wherein the main body is formed with a caster supporting portion, and a caster is positioned in and connected to the caster supporting portion.

* * * * *